United States Patent [19]

Gloeckle

[11] Patent Number: 4,904,104

[45] Date of Patent: Feb. 27, 1990

[54] FASTENER FOR UNPERFORATED WRITTEN MATTER

[75] Inventor: Friedrich Gloeckle, Korb, Fed. Rep. of Germany

[73] Assignee: Hetzel & Co., Fed. Rep. of Germany

[21] Appl. No.: 202,232

[22] Filed: Jun. 3, 1988

[30] Foreign Application Priority Data

Jun. 4, 1987 [DE] Fed. Rep. of Germany ..... 3718664
Oct. 13, 1987 [DE] Fed. Rep. of Germany ..... 3734569

[51] Int. Cl.[4] ..... B42F 13/00
[52] U.S. Cl. ..... 402/80 R; 281/45
[58] Field of Search ..... 402/80 R; 281/45

[56] References Cited

U.S. PATENT DOCUMENTS 3,099,269 7/1963 Sorensen ..... 129/37

FOREIGN PATENT DOCUMENTS 1903530 5/1964 Fed. Rep. of Germany .
744958 2/1956 United Kingdom .

*Primary Examiner*—Paul A. Bell
*Attorney, Agent, or Firm*—Steele, Gould & Fried

[57] ABSTRACT

A clamping folder for unperforated written material containing a rear folder cover (14), which is connected using a folded back (13) with a narrow strip (17), to which is welded a front sheet made from transparent or translucent plastic. A clip (16) is used for securing the written matter and is secured against removal in that it engages on one edge (19) of the folder. Edge (19) can e.g. be formed by a slot (15). The engagement of clip (16) for preventing removal can take place on both the front and rear sides.

21 Claims, 6 Drawing Sheets

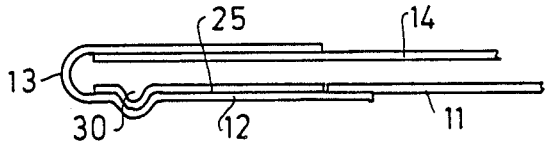
FIG. 8
FIG. 9
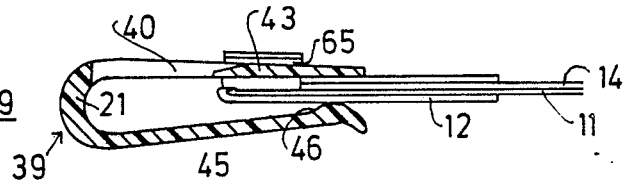
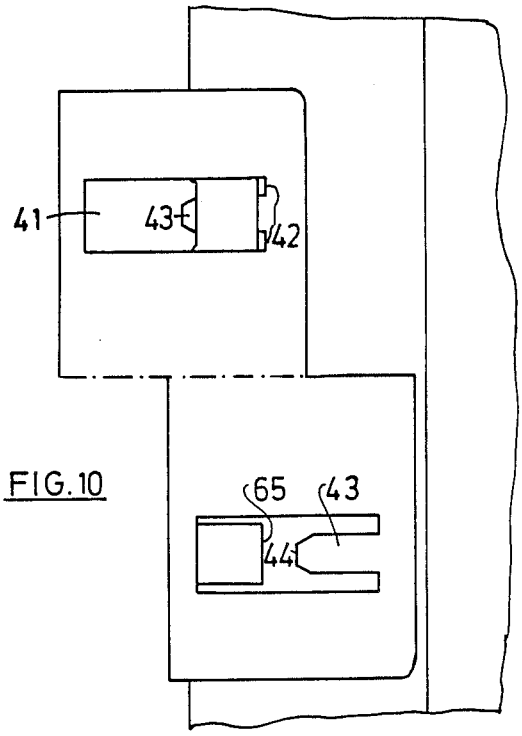
FIG. 10

FASTENER FOR UNPERFORATED WRITTEN MATTER

BACKGROUND OF THE INVENTION

1. Field of the Invention

The invention relates to a clamping folder for sheets, and in particular for unperforated written, typed or printed matter, with two folder covers interconnected along a back or spine and a cross-sectionally, approximately U-shaped clip, which is displaceable at right angles to the back axis and is undetachably secured to the folder.

2. Prior Art

A fastener of this type is known, in which the rear folder cover is curved twice by in each case 90° for forming a back or spine. The narrow strip formed as a result of this on the front side is again bent over, so that the bent over part comes to rest between the strip and the rear wall. The free edge is then again folded back forwards, so that a fold is obtained, behind which is fixed the bent over leading edge (U.S. Pat. No. 3099269). The total of four bending operations of the rigid PVC foil represents considerable production effort and leads to a very high production price.

The object of the present invention is to provide a fastener, which has a simpler construction and which is therefore less expensive to manufacture. According to the invention this object is achieved in that the clip is constructed for engagement on an edge directed away from the back of the folder. This edge can be positioned in the vicinity of the back or at a limited distance in front of the same. There is no longer any need for the front leg of the clip to engage in a slot and can instead be visibly arranged on the front side of the front folder cover. The displaceability of the clip in one direction is limited by the back of the folder engaging with the inside of the clip web. In the reverse direction the displaceability is limited by the clip engaging against said edge. In order that the clip can engage on said edge, it can have a barb-like profile. According to a further development the edge is formed by the border of a cut or slot. If the latter is positioned in the immediate vicinity of the back of the folder, it opens automatically as a result of the tension of the material in the back region.

The edge against which the clip engages can also be formed by a forwardly bulged out bead, which can e.g. be produced by deep drawing.

According to a further development, the front folder cover can be formed by a narrow strip connected to the rear folder cover and a translucent or transparent plastic sheet is articulated by means of a film hinge to the border thereof. The fitting of such a film hinge, which can be very easily produced at the time of welding a plastic sheet, ensures that even in the case of a sudden, jerky wide opening of the folder there is no displacement of the clip, so that the fastened written matter remains secured. This also permits the turning of the pages.

According to a further development, the front strip and/or the rear cover is constructed in double-walled manner in the area adjacent to the back of the folder. The double wall can e.g. be produced in that in the vicinity of the back a strip forming the latter can be welded to the rear folder cover and optionally part of the front folder cover. This strip can be made from a softer material than the rear folder cover, which is preferably made from rigid PVC. As a result of the double wall, it is relatively easily possible to produce slits or cuts, which can be used for fixing the clip.

The edge against which the clip engages can be advantageously formed by the border of a punched portion, whose width roughly corresponds to the displacement path and whose length approximately corresponds to the length of the front leg of the clip. The free edge of the front leg of the clip can be located in said punched portion. This ensures that the clip is laterally guided during displacement, so that the user is assisted in the handling of the folder.

According to a further development the contact edge for the clip is positioned on the rear side of the folder, i.e. in the vicinity of the rear folder cover. This is particularly advantageous if the folder is to be used for a thicker stack of written matter, e.g. 3 mm or more thick. There is then no need to provide a barb-like profile from the inside of the front leg, so that the available opening angle is significantly increased. It is naturally also appropriate and possible to construct a flat engagement or contact rib on the inner edge of the front leg, which leads to a reinforcement of the fixing pressure of the clip. This e.g. 0.2 mm thick rib is, however, so small that it does not impair the opening angle. For guiding or fixing the clip on its rear leg, it is possible to provide it there with at least one tongue or the like engaging in an opening. It is particularly advantageously to provide two uniformly distributed tongues. The openings in which said tongues engage can e.g. have a pocket-like construction, so that the tongues are laterally inserted into the same. It is also possible for the tongues to be in the extension of the clip and to engage in in each case one slot at right angles to the back. The attachments are guided in the space between the two walls by the slot, which is now constructed in the outer wall of the double wall part. Various possibilities can be provided for the insertion of the clip, e.g. slots therein, which permit a springing together of the attachments or the like.

It is naturally also possible to guide both the front and rear of the clip and to engage same against contact surfaces.

According to a further development, the front leg of the clip can engage in a slot provided in the front folder cover and the edge of the clip is fixed behind the edge of the slot facing the folder back. As a result of these inventively proposed measures, it is possible to effect only a single folding operation for producing such a clamping folder, namely a 180° fold for forming the folder back. The slot which has a certain distance from the back simultaneously serves to prevent the complete pulling out of the clip. However, it is no longer necessary to carry out a multiple turning or wrapping over of the strip on the edge of the folder back, in order to form an abutment for the clip.

According to a further development, in the vicinity of the slot on the side of the front cover facing the rear cover is fixed an insert in such a way that the front leg of the clip engages on the front of the insert. This ensures that the clip does not engage directly onto the documentation to be secured, which is located between the insert of the rear folder cover.

According to a further development, the front folder cover is formed by a strip optionally connected in one piece of the rear folder cover and a sheet fixed to its inside extending between the strip and the rear folder cover approximately up to the edge of the slit facing the folder back. This leads to the formation of a folder which, despite a considerably simplified manufacture, corresponds in appearance to the existing folders of this type. The strip can be made roughly as wide as the front leg of the clip.

Naturally the strip and the rear folder cover can be formed from separate parts, which are connected directly or with a back. In the case of production from plastic, said parts can be interconnected by a welding process, which makes it possible to produce several weld seams.

According to a further development of the invention, in the vicinity of the slot, the front sheet is only connected to the strip in the vicinity of its edge remote from the folder back. This means that a portion of the front sheet projecting in the direction of the folder back forms the insert on which the clip engages, so that the clip is not in contact with the paper to be secured.

According to the invention, the folder can be made from plastic, which has the necessary strength. It is particularly favorable to make the rear folder cover and optionally the strip, from PVC, particularly rigid PVC, whilst the front sheet is advantageously made from a translucent or at least transparent plastic. This front sheet can also have a reduced rigidity compared with the rear cover.

The hitherto used spring steel clips must be hardened, cleaned and painted. This is not always particularly easy in view of the relatively complicated shape, so that the results are not always satisfactory. Thus, e.g. paint dust can be deposited on the clips and there is also a corrosion risk. Therefore the present invention proposes making the clip from plastic. This also has the advantage that for preventing the dropping out of the clip there is no longer a need, as is the case with spring steel clips, to bend over the leading edge of the front leg and in fact a small undercut, e.g. in the form of an edge is adequate.

BRIEF DESCRIPTION OF THE DRAWINGS

Further features, details and advantages of the invention can be gathered from the following description of preferred embodiments and the attached drawings, wherein are shown:

FIG. 8, a section corresponding to FIG. 2 through a fourth embodiment.

FIG. 9, a section corresponding to FIG. 8 through a fifth embodiment.

FIG. 10, the rear view of the embodiment of FIG. 9.

DETAILED DESCRIPTION OF THE PREFERRED EMBODIMENT

Figure 1:
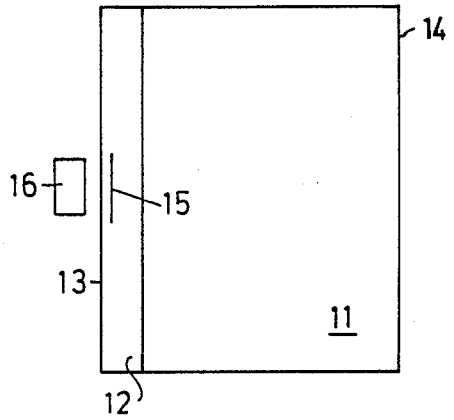
FIG. 1, a front view of a first embodiment of the clamping folder with the clip removed.

The clamping folder shown from the front in FIG. 1 has a front sheet 11, preferably made from a transparent or translucent plastic, which is applied and in particular welded to a strip 12. In the vicinity of its left-handside in FIG. 1, strip 12 forms the folder back 13. Behind the front sheet is located the rear folder cover 14 visible through said front sheet 11. The rear folder cover 14 and the strip 12 are punched in one piece from a piece of foil, which is in particular made from rigid PVC and folded over for forming the back 13. Instead of production from a piece of foil, it is also possible to produce both parts separately and to interconnect them in the vicinity of back 13, either directly or with the aid of a strip forming back 13. The necessary weld seams can be produced in a single welding process, so that neither the costs, nor the manufacturing time are increased.

In strip 12 is made a slit or cut 15 centrally with respect to its longitudinal extension and parallel to back 13. The said slit has a limited distance of e.g. approximately 3 to 5 mm from back 13. Onto the folder can be mounted an elastic clip 16, intimated in FIG. 1, which is approximately U-shaped in cross-section and whose two legs are pretensioned towards one another. Through the mounting of clip 16, it is possible to secure unperforated written matter between the front sheet 11 and the rear folder cover 14. Clip 16 is secured in such a way that as soon as it is inserted, it cannot be readily detached again and is displaceable in a direction at right angles to back 13.

Figure 2:
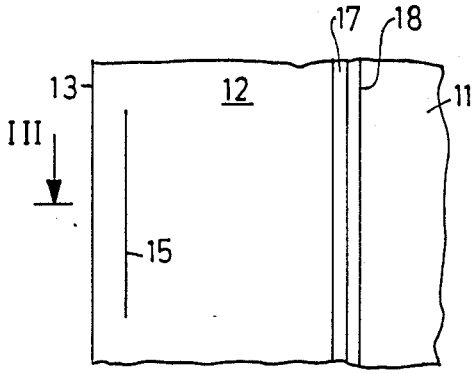
FIG. 2, on a greatly increased scale a partial view of the folder point at which the clip is to be applied.

FIG. 2 is a larger scale plan view of the area of the folder around slit 15. The front sheet 11 is welded with the aid of a weld seam 17 in the vicinity of the border edge 18 of strip 12 remote from back 13, the weld seam being such that it forms a film hinge. Thus, the front sheet 11 can be flapped round the hinge, so that it is possible to turn over the pages in the folder.

Figure 3:
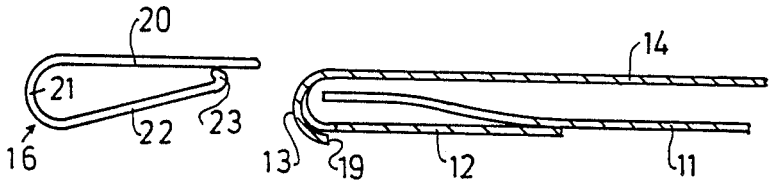
FIG. 3, a section through the folder with the clip removed.

FIG. 3 shows in the same scale as FIG. 2 a section roughly along line III—III of FIG. 2. The slit 15 is arranged in an area of the folder, where it has a certain tension due to the folding over in the back. As a result the slit opens somewhat, so that as a result an edge 19 directed away from back 13 is formed. This edge is most readily apparent in the center of slit 15, whereas it is less marked in the marginal area of slit 15. The length of the latter is somewhat larger than the length of clip 16 measured in the same direction.

Clip 16 is roughly U-shaped, cf. to the left in FIG. 3, and has a rear leg 20, which is connected by means of a bow 21 to the front leg 22. The plastifc clip 16 is so constructed in the normal state, i.e. in the relieved state, that the two legs 20,22 are in the represented position. A barb-like profile 23 is shaped on the end of the front leg 22 and serves to secure the clip 16. The latter is made from plastic and has elastic qualities. For fitting the clip 16 to the folder, clip 16 is spread apart somewhat and engaged on the clamping folder. The distance between the ends of the legs 20,22 present when clip 16 is not deformed is a function of the dimensions, i.e. is essentially dependent on the thickness of the unfilled folder.

Figure 4:
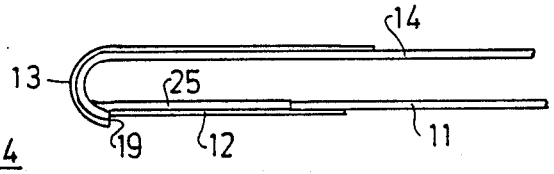
FIG. 4, a section corresponding to FIG. 3 through a second embodiment.

If the clip is placed on the folder, i.e. in the longitudinal direction of the latter, then said clip is displaceable between an extreme position, where the back 13 engages on the inside of bow 21 of clip 16 and a second position at right angles to the back, were the barb-like profile 23 engages on the edge 19 of slit 15. In the latter position it is possible to insert sheets between the front sheet 11 and the rear back cover 14, which are then jammed by a displacement of clip 16. The front leg 22 of the clip is still on the front side, i.e. the outside of strip 12. Whereas in the embodiment of FIG. 3 the rear cover 16 passes in one piece into strip 12, in the embodiment of FIG. 4, which is also a cross-section, the strip 12 is formed by a thin foil, which is passed round the back 13. Thus, the folder is constructed in double-walled manner in an area parallel to back 13 corresponding to the width of strip 12. The cut or slit 15, which is made in much the same way as in the embodiment of FIG. 1, is somewhat more readily visible and forms a clearly defined edge 19.

Figure 5:
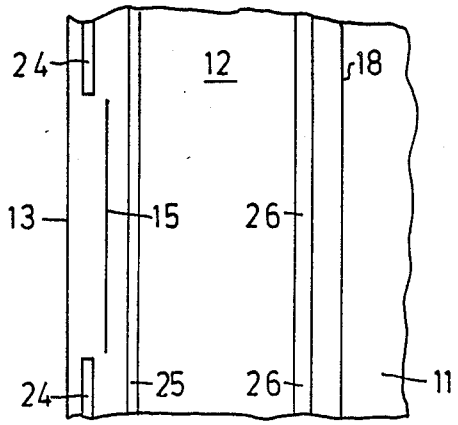
FIG. 5, a larger scale detailed view of the second embodiment.

As can be gathered from FIG. 5, which is a front view of the slit area of the folder, when considered in the longitudinal direction of back 13, in the extension of slit 15 is provided in each case one weld seam 24, which together with a further weld seam 25 running parallel to the slit and the following weld seam 26 serve to fix a narrow rigid PVC strip to the inside of strip 12. A front sheet once again formed from a transparent or translucent plastic foil is welded to the edge 18 of the strip.

Figure 6:
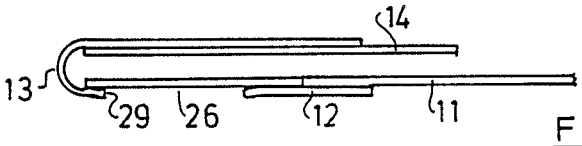
FIG. 6, a section corresponding to FIGS. 3 and 4 through a third embodiment.

In the embodiment according to FIG. 6, a wide punched piece 26 and not a slit 15 is provided in the double-walled strip 12. This rectangular punched piece 26 is surrounded by weld seams 24,27, which weld the front wall of strip 12 to the strip 25 behind it. Borders 28 in each case have a certain distance from the associated weld seams and are, as can be gathered from FIG. 6, displaced forwards from the rear strip, so that at least towards the back 13, a clearly defined edge 29 is formed, behind which is secured clip 16 with its barb-like profile. The dimensions of punched portion 26 are chosen in such a way that its width, i.e. its extension to be seen in FIG. 6, roughly corresponds to the displacement path of clip 16, while its length, i.e. the dimension measured parallel to back 13 in FIG. 7, roughly corresponds to the length of clip 16. The barb-like profile of clip 16 during the use of the folder is then located in punched portion 26, so that no only is it possible to prevent removal by engagement on edge 29, but also the clip is laterally guided in its other movements.

In the fourth embodiment according to FIG. 8, the folder is again given a double-walled construction in the area adjacent to back 13. The rigid PVC strip is located behind the front strip 12 and forms at the point where in the previous embodiments edge 19 or 29 was located, a bead 30. The latter projects forwards from the surface of strip 12 and also serves to secure the clip with the aid of its barb-like profile. It is also possible to combine the embodiments of FIGS. 6 and 8, so that in addition to bead 30 the front strip 12 also has a punched portion at this point, whose edge would form a contact edge 29 reinforcing bead 30.

Whereas in the previously discussed embodiments the clip is in each case secured against removal on the front of the folder, in the case of the embodiments shown in FIGS. 9 and 10 the clip is guided on the rear of the folder and secured against removal. For this purpose the rear leg 40 of clip 39 has an approximately rectangular recess 41 at right angles to the longitudinal direction of the clip and at whose edge 42 remote from bow 21 is provided a tongue 43, which is roughly located at the plane of the rear leg 40 of the clip and projects into recess 41. Tongue 43 is roughly as long as recess 41. The free end 44 of tongue 43, cf. FIG. 9, is chamfered somewhat and optionally projects into the gap between the two legs 45,46. This is intended to ensure that the tongue 43 during displacement passes into a recess 65 of the folder. The lower half of FIG. 10 shows the clip in a position in which it secures the paper in the folder. For release purposes, the clip is moved into the position shown in the upper half of FIG. 10, where the tongue 43 engages in recess 65.

Recess 65 in the embodiment of FIG. 10 is formed by a tunnel-like bending out of the material of the rear of the clamping folder. In the represented embodiment, recesses 65 are open from either side.

The clip shown from the rear in FIG. 10 has two recesses 41 with tongues 43, but in certain circumstances it is only necessary to use one such recess with tongue 43.

In the case of said clip 39, which is guided on the back of the folder, the front leg 45 is provided in the vicinity of its border edge with a flat, rounded contact rib 46, which is significantly flatter than the barb-like profile 23 of clip 16. As a result of the considerably reduced depth of rib 46, the available opening angle of clip 39 is much larger, so that this embodiment can also be used for thicker paper stacks.

Figure 11:
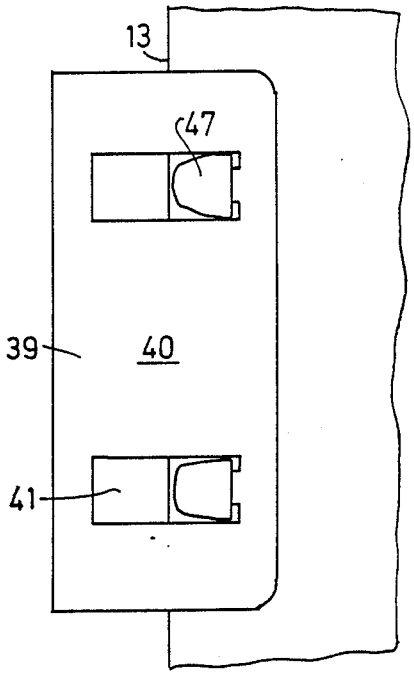
FIG. 11, a rear view corresponding to FIG. 10 of a further embodiment.

In place of the tunnel-like recesses 65 of the embodiment of FIGS. 9 and 10, in the embodiment according to FIG. 11 a pocket 47 is provided in the back of the folder which is only open on one side, i.e. its opening is directed away from back 13. In the embodiment according to FIG. 11 it is possible to use the same clip 39 as in the embodiment of FIGS. 9 and 10.

Figure 12:
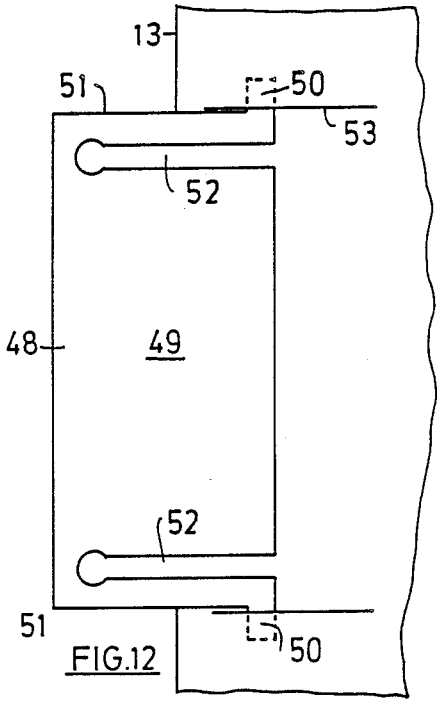
FIG. 12, the rear view of a clip of a further embodiment.

In the embodiment of FIG. 12 use is made of a clip 48, whose rear leg 49 has two attachments 50 projecting in the longitudinal direction of clip 48. Parallel to the front edges 51 of clip 48 there are two slit-like cuts 52 in the rear leg 49 extending essentially over the entire width of rear leg 49 and lead to a resilient construction of the attachments 50. Attachments 50 engage in slots 53 of the in this area double-walled folder, slots 53 extending at right angles to the folder back 13. As a result of said engagement of attachments 50, clip 49 is secured in a displaceable and undetachable manner.

Figure 13:
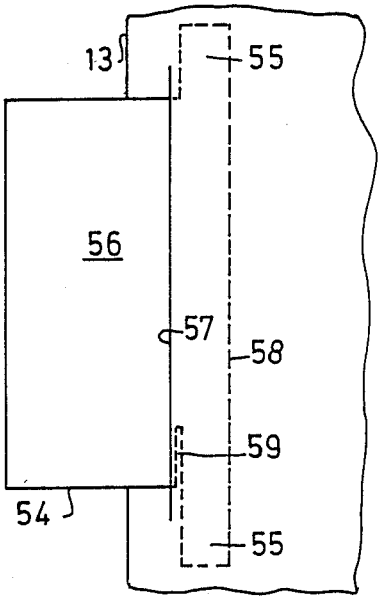
FIG. 13, a rear view corresponding to FIG. 12 of a further embodiment.

In the embodiment according to FIG. 13 clip 54 has two similarly constructed attachments 55, but in this case the rear leg 56 is totally inserted through a slot 57, which is parallel to the folder back 13. The two attachments 55 prevent the drawing out of the clip. In order to be able to insert the clip, a slit 59 is provided parallel to the free edge 58 of the rear leg 56 through which it is possible to move clip 54 so far downwards in FIG. 13 that the upper attachment 55 can be drawn out.

Figure 14:
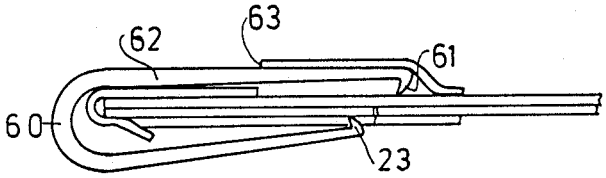
FIG. 14, a section corresponding to FIG. 9 through a further embodiment.

FIG. 14 shows an embodiment in which the clip 60 has both a barb-like profile 23 on the free edge of its front leg and also such a profile 61 on the free edge of its rear leg. The barb-like profile 23 of the front leg is guided in a similar manner to the embodiment of FIGS. 7 and 8, while the rear leg 62 engages in a pocket formed by a slot 63 and is guided therein by profile 61.

Figure 7:
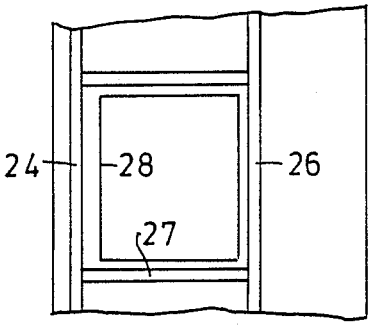
FIG. 7, a larger scale view of the embodiment of FIG. 6.

In embodiments where the clip is secured in the vicinity of the rear side, it is possible to provide on the front side a guidance of the front leg in much the same way as in the embodiment of FIGS. 6 and 7, without the clip having to have a barb there.

Embodiments are obviously conceivable in which there is both a guide on the front side and on the rear side. Therefore features of the guide on the rear side can be combined with features on the front side.

Figure 15:
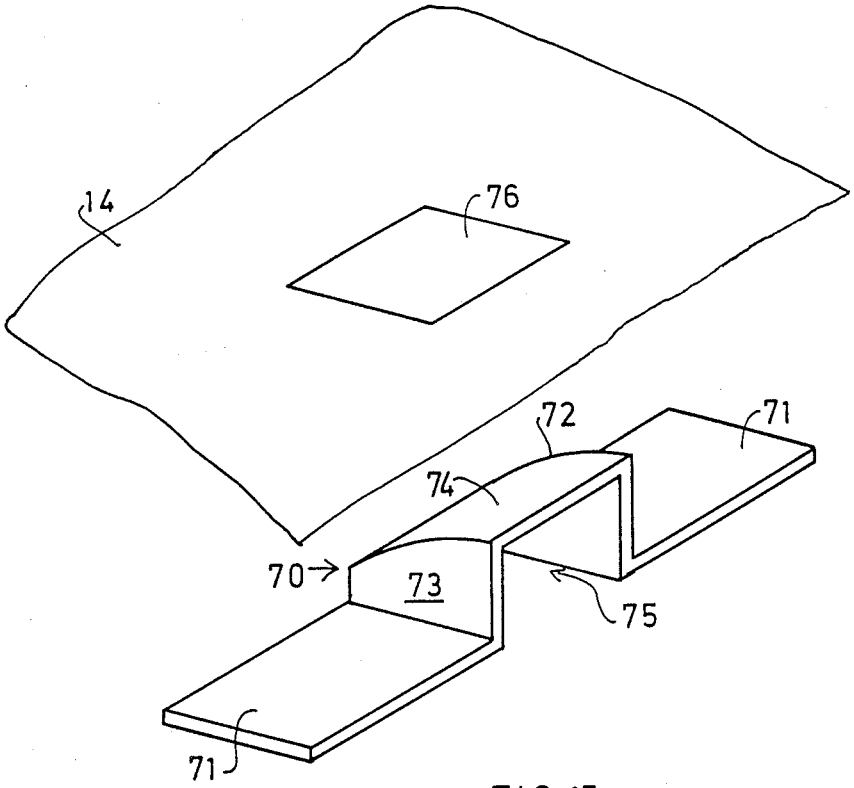
FIG. 15, a view of an insert for forming an opening.

Whereas in the embodiments of FIGS. 9 to 11 the tongues 43 or attachments on the clip engage in pockets, which are formed in the material of the folder, it is also possible to produce as a separate component the openings in which the tongues engage. An example for this is shown in FIG. 15, where an insert 70 is provided, which is elongated and has two lateral, plate-like attachments 71, which are connected in one piece to one another by a cross-sectionally, approximately U-shaped deflection 72. The latter has two approximately vertically directed side walls 73, which are interconnected by a cover 74. The roof-like cover 74 is slightly bent, so that the deflection from the side has a slight desk-shaped construction. On the side to the front right in FIG. 15 is formed an opening 75 for receiving a tongue 43 or 50 and 55. Insert 70 shown in FIG. 15 is inserted from below through an opening 76 in a folder cover, preferably the rear folder cover 14, so that the opening 75 is arranged on the outside of the cover for receiving the tongue. The relatively large attachments 71 ensure that the material is not excessively stressed, so that the service life is increased. If the side walls 73 slope slightly, so that the deflection 72 is somewhat larger on its top surface that in the vicinity of the plate-like attachment 71, there can also be a certain locking of insert 70 in the opening 76 of the folder cover 14.

As shown in FIG. 15, the insert 70 can cooperate with the most varied embodiments of the clamping folder, it obviously also being possible to provide an insert which has two deflections 72 for forming two openings 75. Such an insert can then cooperate with clips of the embodiment according to FIGS. 10 and 11. The use of insert 50 of FIG. 15 also makes it possible to make the folder cover e.g. from cardboard, because insert 70 then serves to guide and secure the clip.

Figure 16:
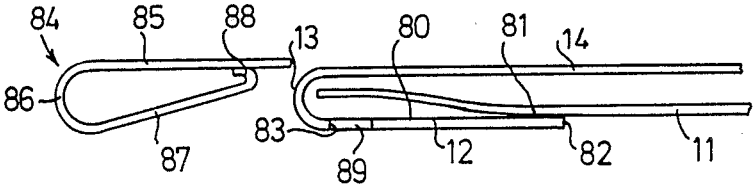
FIG. 16, a cross-section through the folder with the clip not yet inserted in the case of another embodiment.

FIG. 16 shows a section through another folder in the vicinity of its back 13. The rear folder cover 14 and strip 12 are punched in one piece from a preferably rigid PVC plastic foil and folded for forming the back or spline 13. On the back surface 80 of strip 12, i.e. the side facing the rear folder cover 14, is fixed, preferably by welding the front sheet 11. The weld seam 81 is located in the vicinity of the free edge 82 of strip 12. However, the front sheet 11 extends to just before the inside of back 13 into the gap between strip 12 and the rear cover 14. Thus, its extends somewhat further than the edge of the slot facing back 13.

Figure 17:
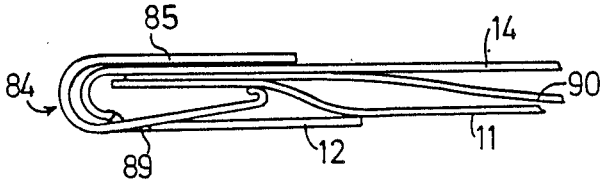
FIG. 17 the same cross-section with the clip inserted and an inserted paper sheet.

Clip 84, which is e.g. made from spring steel, has an approximately U-shaped cross-section, formed by a rear leg 85 and a front leg 87 connected thereto by means of a web 86. As a result of the elastic material the front leg 87 is moved towards the rear leg. In the vicinity of its free edge, the front leg 87 is rearwardly bent over and consequently forms a barb 88. For forming the clamping folder proposed by the invention, the front leg 87 of clip 84 is bent away from the rear leg 85 and the clip is so engaged on the folder that the front leg 87 passes through slot 89, whilst the rear leg 85 engages with the back of the rear folder cover 14. Thus, the means proposed by the invention passes into the position shown in FIG. 17, where the rear leg 85 of clip 84 engages on the back of the rear folder cover 14. The free edge of the front leg 87 is located with its barb 88 in the gap between strip 12 and the rear end of the front sheet 11. Between front sheet 11 and the rear folder cover 14 is inserted a paper sheet 90, which is secured by the clamping action of clip 84.

The paper sheet 90 can be released again in that the clip 84, which can be gripped by a user, is moved outwards from back 13 until the paper 90 is freed. Clip 84 cannot be completely drawn out of the folder, because barb 88 remains stuck behind edge 83 of slot 89.

Written matter to be fastened in the folder is inserted between front sheet 11 and rear cover 14 with clip 84 moved outwards and then the clip is inserted in the direction of back 13. Barb 88 then slides over the front sheet 11 into the position shown in FIG. 17.

If clip 84 is made from plastic instead of spring steel, then the design of barb 88 is also much simpler. A removal of the clip is prevented if a small undercut is positioned behind an edge or the like on the inside of the front leg 87.

The folder proposed by the invention can be made much more simply and therefore inexpensively than the known folders. Independently of the number of weld seams, only a single welding process and a single bending over is required for forming the back 13. The folder material can in particular be PVC, namely both rigid and plasticized PVC.

I claim:

1. A clamping folder for holding flat sheets such as paper sheets, comprising:

a front folder cover and a back folder cover, said front and back folder covers being interconnected along a back defining a spline;

a cross-sectionally substantially U-shaped clip operable to slide over the spline and holding the front and back folder covers between a front leg and a rear leg of the clip, the clip having on the rear leg thereof at least one tongue; substantially coplanar with said rear leg, the tongue being engageable in an opening formed on said back folder cover, the clip being secured from detachment fron the front and back folder covers by engagement with an edge formed on the folder.

2. The clamping folder according to claim 1, wherein the tongue is formed in a recess in the rear leg of the clip, the tongue extending in a direction of displacement of the clip, the tongue extending toward the spline and being engageable in the opening by sliding the clip towards the spline.

3. The clamping folder according to claim 2, wherein the opening is defined by a pocket bent out from the back folder cover.

4. The clamping folder according to claim 1, comprising two said tongues arranged to project from the clip in a direction parallel to the spline, said two tongues engaging in at least one slot formed in the back folder cover.

5. The clamping folder according to claim 1, further comprising a barb-like profile on an inside of the front leg of said clip, the profile engaging the edge formed on the folder.

6. The clamping folder according to claim 1, wherein the edge formed on the folder is defined by a border of a cut.

7. The clamping folder according to claim 1, wherein the edge formed on the folder is defined by a raised bead.

8. The clamping folder according to claim 1, wherein the front folder cover comprises a narrow strip connected to the rear folder cover, and an at least translucent plastic sheet articulated by means of a film hinge to said edge formed on the folder.

9. The clamping folder according to claim 8, wherein the strip is double-walled in an area adjacent to the back folder cover.

10. The clamping folder according to claim 8, wherein the rear folder cover is double-walled in an area adjacent to the back folder cover.

11. The clamping folder according to claim 1, wherein the edge formed on the folder is defined by a border of a punched portion having a width substantially corresponding to a displacement path of the clip and a length substantially corresponding to a length of the front leg of the clip.

12. The clamping folder according to claim 1, wherein the opening formed in the back folder cover for receiving the tongue is defined in part by an insert partly projecting through an opening formed in one of said folder covers.

13. The clamping folder according to claim 1, wherein on an inside of the front leg of the clip, the clip has a flat contact rib, the flat contact rib increasing contact pressure exerted by the clamping folder.

14. The clamping folder according to claim 1, wherein the clip is secured on both the front folder cover and the rear folder cover.

15. The clamping folder according to claim 1, wherein a front leg of the clip engages in a slot in the front folder cover, the slot being located in a vicinity of the back folder cover and an edge of the clip is adapted to be secured behind a border defined by said slot, facing the back folder cover.

16. The clamping folder according to claim 15, wherein the front folder cover comprises a strip connected in one piece with the rear folder cover, and a sheet fixed to an inside of the rear folder cover extending between the strip and the rear folder cover substantially to the border of the slot facing the back folder cover, the strip being substantially as wide as the front leg of the clip.

17. The clamping folder according to claim 16, wherein in a vicinity of the slot, the sheet is only connected to the strip in a vicinity of an edge of the strip remote from the back folder cover.

18. The clamping folder according to claim 1, wherein at least one of the rear folder cover and the strip is made from PVC.

19. The clamping folder according to claim 1, wherein in a vicinity of the slot, an insert is fixed to a side of the front folder cover facing the rear folder cover such that the front leg of the clip engages on a front of the insert.

20. The clamping folder according to claim 1, wherein the front sheet is transparent plastic.

21. The clamping folder according to claim 1, wherein the clip is plastic and has a slight undercut for fixing the clip to the edge formed on the folder.

* * * * *